US008102251B2

(12) United States Patent
Webb

(10) Patent No.: US 8,102,251 B2
(45) Date of Patent: Jan. 24, 2012

(54) THREAT DETECTION AND MONITORING APPARATUS WITH INTEGRATED DISPLAY SYSTEM

(75) Inventor: Gregory E. Webb, Arlington Heights, IL (US)

(73) Assignee: Infraegis, Inc., Elk Grove Village, IL (US)

( * ) Notice: Subject to any disclaimer, the term of this patent is extended or adjusted under 35 U.S.C. 154(b) by 267 days.

(21) Appl. No.: 12/065,895

(22) PCT Filed: Sep. 6, 2006

(86) PCT No.: PCT/US2006/034730

§ 371 (c)(1),
(2), (4) Date: Jul. 15, 2008

(87) PCT Pub. No.: WO2007/030549

PCT Pub. Date: Mar. 15, 2007

(65) Prior Publication Data

US 2008/0316017 A1 Dec. 25, 2008

Related U.S. Application Data

(60) Provisional application No. 60/714,479, filed on Sep. 6, 2005.

(51) Int. Cl.
*G08B 1/08* (2006.01)

(52) U.S. Cl. ..... 340/539.1; 340/500

(58) Field of Classification Search ..... 340/539.1, 340/500, 573.1; 600/301
See application file for complete search history.

(56) References Cited

U.S. PATENT DOCUMENTS

| | | | | |
|---|---|---|---|---|
| 4,931,646 | A | 6/1990 | Koechner | |
| 5,692,029 | A | 11/1997 | Husseiny et al. | |
| 6,496,110 | B2 | 12/2002 | Peterson et al. | |
| 6,590,496 | B2 | 7/2003 | Peterson et al. | |
| 6,648,552 | B1 | 11/2003 | Smith et al. | |
| 6,768,116 | B1 | 7/2004 | Berman et al. | |
| 6,946,671 | B2 | 9/2005 | Smith et al. | |
| 7,058,484 | B1 | 6/2006 | Potega | |
| 7,127,623 | B2 | 10/2006 | Potega | |
| 7,183,554 | B2 | 2/2007 | Gallagher et al. | |
| 7,271,720 | B2 | 9/2007 | Tabe | |
| 2004/0036596 | A1 | 2/2004 | Heffner et al. | |
| 2004/0063197 | A1 * | 4/2004 | Tilles et al. | 435/287.2 |
| 2004/0220753 | A1 | 11/2004 | Tabe | |
| 2005/0055330 | A1 | 3/2005 | Britton et al. | |
| 2005/0062603 | A1 | 3/2005 | Fuerst et al. | |
| 2006/0276943 | A1 | 12/2006 | Anderson | |
| 2007/0002140 | A1 | 1/2007 | Benson et al. | |
| 2007/0122003 | A1 | 5/2007 | Dobkin et al. | |
| 2008/0191858 | A1 * | 8/2008 | Skatter | 340/500 |
| 2008/0262321 | A1 * | 10/2008 | Erad et al. | 600/301 |

(Continued)

FOREIGN PATENT DOCUMENTS

| | | | |
|---|---|---|---|
| EP | 0169756 | B1 | 8/1989 |

(Continued)

*Primary Examiner* — Shirley Lu
(74) *Attorney, Agent, or Firm* — McDermott Will & Emery LLP

(57) ABSTRACT

The present invention is generally related to a threat detection and monitoring apparatus with an integrated display system. More particularly, the present invention is directed to an apparatus for use as a public safety and emergency messaging system adapted to detect and identify threats in the surrounding environment and display useful information regarding the threat or other public information to the public.

13 Claims, 3 Drawing Sheets

U.S. PATENT DOCUMENTS

| | | |
|---|---|---|
| 2008/2620321 | 10/2008 | Erad et al. |

FOREIGN PATENT DOCUMENTS

| | | | |
|---|---|---|---|
| EP | 0794425 | A1 | 9/1997 |
| RU | 2065156 | C1 | 8/1996 |
| RU | 2094956 | C1 | 10/1997 |
| RU | 2095795 | C1 | 11/1997 |
| RU | 2143711 | C1 | 12/1999 |
| RU | 2156547 | C2 | 9/2000 |
| RU | 2191769 | C2 | 10/2002 |
| RU | 44194 | U1 | 2/2005 |
| WO | 2004059786 | A2 | 7/2004 |

* cited by examiner

| | 30 |
|---|---|
| 41 | Radiological Detection System |
| 40 | Nuclear Detection System |
| 42 | Air conditioning/ Heating System |
| 36 | EBS Computers |
| 35 | Router |
| 38 | Communications Device |
| 39 | Computer Aided Trace Detection System (CATD) |
| 37 | Multi-Array Computers |
| 43 | Gas Detection System |
| 44 | Uninterruptible Power Supply |
| 27 | Loudspeaker System |
| 26 | Speaker System |
| 24 | Antenna Array |

FIG. 3

THREAT DETECTION AND MONITORING APPARATUS WITH INTEGRATED DISPLAY SYSTEM

This application claims priority to U.S. Provisional Application Ser. No. 60/714,479 filed on Sep. 6, 2005, the entire contents of which is hereby incorporated by reference herein.

FIELD OF THE INVENTION

The present invention generally relates to a threat detection and monitoring apparatus with an integrated display system. More particularly, the present invention is directed to an apparatus for use as a public safety and emergency messaging system adapted to detect and identify threats in the surrounding environment and display useful information regarding the threat or other information to the public.

BACKGROUND OF THE INVENTION

With the advent and growth of terror groups around the world, inter alia, it has become necessary to have the ability to detect dangerous substances and methodologies at the earliest occasion. For example, the detection of radiation and nuclear materials, chemicals, biological materials, explosives, contraband, chemicals and dangerous humans is of the utmost importance in today's society. Due to the complexities surrounding the presence and identification of the extensive instruments of destruction available to terrorists, there has not been, until the present, instrumentation or methodology available by which a wide range of potentially destructive agents can be countered.

The subject matter described in U.S. Pat. No. 7,012,520 and U.S. Pat. No. 7,046,138 is hereby incorporated by reference herein.

The present invention addresses the shortcomings in systems of prior art threat detection systems, while providing the above mentioned desirable features.

SUMMARY OF THE INVENTION

The purpose and advantages of the invention will be set forth in and apparent from the description and drawings that follow, as well as will be learned by practice of the invention.

The present invention generally relates to a threat detection and monitoring apparatus with an integrated display system. It is a public safety and emergency messaging system designed and developed to solve the funding shortfalls cities face as they try to meet today's security needs by advertising to help defray the costs associated with the apparatus. Although designed to operate as a stand alone system, the ultimate goal is that the system will become part of a global system installed in cities around the world.

Generally, the threat detection and monitoring apparatus of the invention includes a display device comprising a viewing screen, such as a flat screen LCD, for displaying information of value to the public. Such information may relate to the presence of any type of weapon of mass destruction (WMD), accompanied by instructions giving directions to safety.

The apparatus includes, also, one or more sensors for detecting a threat or for monitoring surroundings integrated with the display device. Logic systems are present to process information from the sensors and utilize that information to produce appropriate messages for public use. Other logic information may be present to operate the sensors to obtain a predetermined final result. Also included is a communications device coupled to a network that transmits information related to a detected threat and responsive to remote instruction to cause display of relevant information. One of the most important sensors present is a high speed vectoring camera system that is operated by an associated logic system that can observe suspicious behavior of people and then record the behavior. The recorded information is analyzed, then transmitted for action, as desired. The camera can also monitor potential consumers of products and/or companies advertised on the display device to determine the efficacy of the advertising.

The apparatus incorporates a Global Operations Monitoring and Analysis Center (GOMAC) to provide continuous professional monitoring services, maintenance, technical assistance, and quality control assurances. GOMAC is integrated into the apparatus' computer network to monitor, record, analyze, alert, and enact automatic pre-approved electronic countermeasures when a threat is detected by the apparatus. GOMAC's sophisticated automated notification system confirms the proper functioning of each deployed detector.

Thus, the present apparatus meets a variety of objectives including: providing a public face for homeland security; allowing public officials direct access for communicating with citizens; a means for emergency management to provide system-wide announcements, e.g., to supplement the traffic management system by providing information to prevent additional traffic build-up on traffic delays, road construction, or accidents; and as a major revenue source for funding all aspects of homeland security initiatives.

The interface between this apparatus and the public is a ruggedized, flat viewing screen LCD monitor. Apparatuses can be installed and deployed throughout any metropolitan area at public transportation stations; inside rail cars and buses; at bus stops and shelters; in key strategic buildings; and at highly attended events. It can either be mounted on a fixture (e.g., street furniture such as a bus shelter) or installed as a stand-alone kiosk.

Preferably, the apparatus will enable the operator to tap into this market with expanded emergency management capabilities to serve the public good by providing important information on emergency situations as well as traffic and news reports to make commuting easier—saving both time and money.

It is to be understood that both the foregoing general description and the following detailed description are exemplary and provided for purposes of explanation only, and are not restrictive of the invention, as claimed. Further features and objects of the present invention will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein:

FIG. 3 is a schematic front elevation showing how operating parts are located within the kiosk of FIG. 1.

It should be understood that the present invention is not limited to the preferred embodiments illustrated.

DETAILED DESCRIPTION OF THE INVENTION

Figure 1:
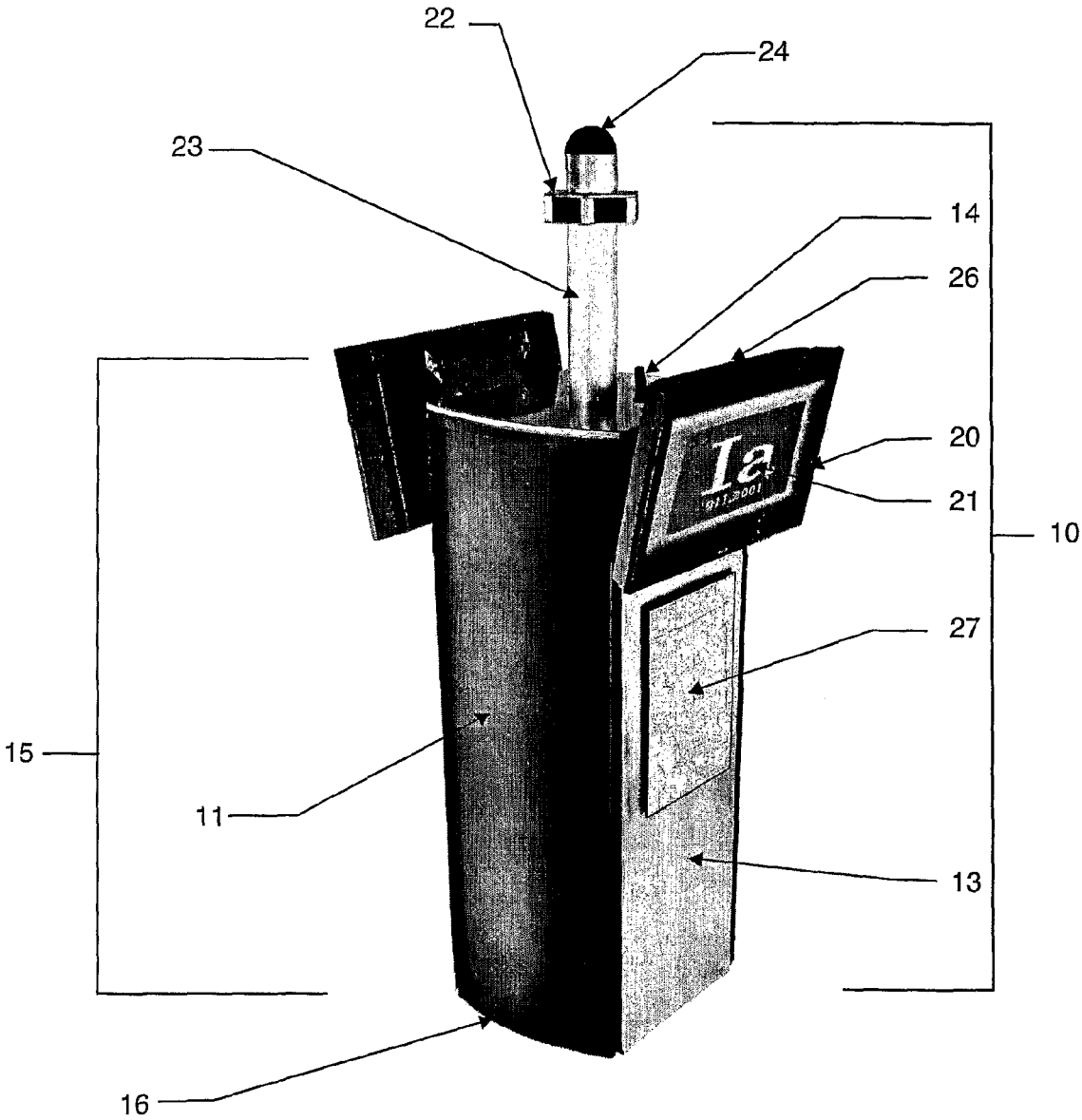
FIG. 1 is a perspective view of the apparatus as a stand alone kiosk constructed according to this invention.
Figure 2:
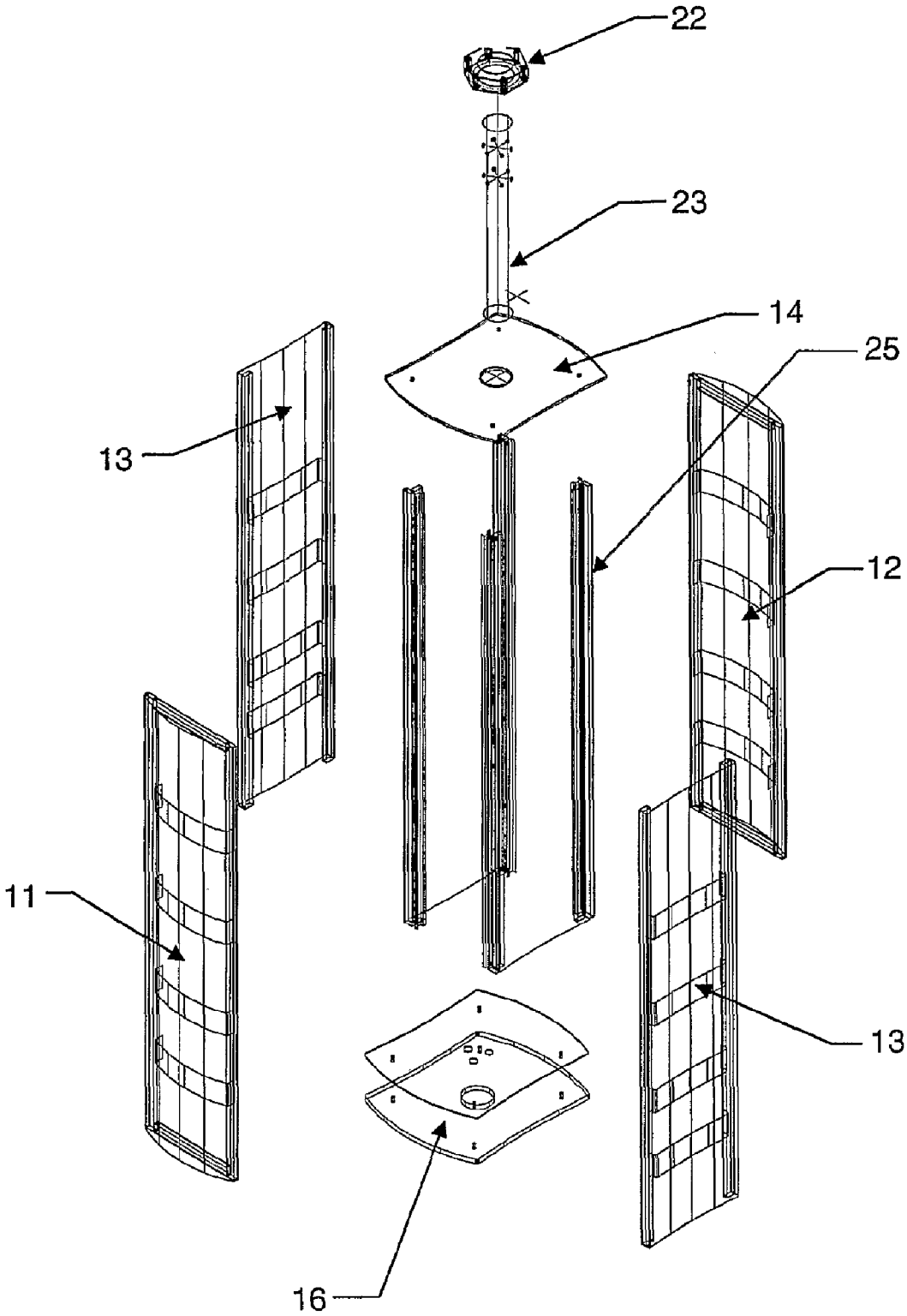
FIG. 2 is a an exploded perspective view of the base structure of the kiosk shown in FIG. 1.

Referring generally to FIGS. 1, 2 and 3, and upon review of this description, it will be appreciated that the apparatus of the present invention generally may be embodied within numerous configurations.

Referring now to a preferred embodiment illustrated in FIGS. 1 and 2, the threat detection and monitoring apparatus 10 has a front door panel 11, a back door panel 12, and two protective side panels 13 that are opposite each other and adjacent said doors to form a substantially rectangular housing 15. The housing 15 also comprises a top closure member 14 and a bottom closure member 16, that, when combined with front door panel 11, back door panel 12 and protective side panels 13, defines an interior chamber for receiving the operation sub-assemblies of the apparatus 10. It will be appreciated that the housing 15 will be securely constructed to prevent damage and weather-related seepage. In the preferred embodiment, the apparatus 10 is made of only weather resistant materials and coatings that are watertight, rainproof, humidity/condensation proof and sunlight/UV resistant. For example, the apparatus 10, which is constructed using high-tech materials and/or methods, can be made of steel/stainless sheet and bar and/or composites. Use of these high-tech materials will dampen potentially harmful vibrations from the apparatus' surrounding environment. The materials used should also be capable of shielding electromagnetic interference (EMI) and radio frequency interference (RFI).

Also now referring to FIG. 3, a display device 20 comprises a flat viewing screen 21, speaker system 26, and a protective climate controlled housing 15. In the preferred embodiment, the display device 20 is attached to the top of each protective side panel 13 with the screen 21 facing outwardly to enable public viewing. The display device 20 displays information of interest on the screen 21 such as public safety and emergency messaging information. It can also display predetermined advertisements to the public at predetermined intervals. The screen 21 is based on LCD or plasma screen technology and is equipped with view brightening technology that enables it to be high-bright or color transflective. The speaker system 26 will provide audio for the video images shown on the display device 20. It will be appreciated that the invention can accommodate numerous mounting options and configurations. It will also be appreciated that any number of display devices 20 and speaker systems 26 can be used with the present invention, as well as a variety of sizes.

A camera array 22 is attached to the top closure member 14 by means of a cylindrical sensor mount 23. In the preferred embodiment of the present invention, the camera array 22 consists of high speed vectoring cameras and is attached around the circumference of the sensor mount 23 to allow for 360 degree picture-taking, pan, tilt and zoom capabilities. The camera array 22 is operated by an associated logic system and incorporates facial and behavioral-recognition software to observe and interpret the facial features and behavior of any individual in its view range. The facial and behavioral-recognition software specifically utilizes said logic system and the camera array 22 to analyze its real-time surroundings and identify potentially dangerous or suspicious human behaviors, incidents or objects. The observed behavior can then be recorded and transmitted for action, as desired. The camera array 22 can also monitor potential consumers of the products and/or companies advertised on the display device 20 to determine the efficacy of the advertising.

As shown in FIG. 3, the mass broadcasting loudspeaker system 27 will allow for audio messaging of emergency broadcasts and information of public interest.

The apparatus 10 will also house, in stand alone or multiple combinations, features with the ability to network cellular, satellite, digital radio (point to point or multipoint) and WiFi systems. These features will serve the purpose of enhancing communications in specific or remote locations for use by private entities or public utilities on a "pay per use" or contract basis. These features could also be deployed into areas disrupted or devastated by natural or man-made disasters.

The apparatus 10 will include an antenna array 25 comprised of any combination of the following: cellular, satellite, digital radio (point to point or multipoint) and WiFi antennae tailored to accommodate the communications apparatus as required to satisfy the specific equipment requirements.

As shown in FIG. 2, the interior chamber for receiving the operation sub-assemblies is defined by four structural support members 25. The operation sub-assemblies are comprised of sensors for detecting a threat or for monitoring surroundings that are integrated with the display device 20, the logic systems that process information from the sensors, and other mechanical components necessary for the functionality of the system. The logic systems utilize processed information from the sensors to produce appropriate messages to be displayed on the display device 20 for public use. The interior chamber is preferably divided horizontally by shelves into vertically aligned terminals 30, as shown in FIG. 3. Within the interior chamber are any number of a variety of sub-assemblies such as: a nuclear detector, a radiological detector, a computer-aided trace detection system, a gunshot detector, a camera, behavioral recognition software, voice intercept software, a communications device, loudspeakers for public address, batteries, an air conditioning/heating unit, a emergency broadcast system (EBS) computers, multi-array computers, a gas detector system to identify specific gases (toxic or dangerous), and routers. It will be appreciated that various sensors and operation sub-assemblies can be used with this invention.

Each operation sub-assembly can be placed into a separate terminal 30. FIG. 3 is a diagrammatic front elevation illustrating the manner in which the operation sub-assemblies can be located within the interior chamber. It will be appreciated that if a particular apparatus does not employ all of the operation sub-assemblies of FIG. 3, any number of terminals 30 can be used to incorporate different components or operation sub-assemblies. Select terminals 30 can also be left empty during use. As shown, in the front elevation of FIG. 3 is a router 35. The router 35 is used as a computer networking device that forwards selected data across the computer network of the invention to a predetermined destination using a fiber-optic, hardwire, coaxial cable or wireless network. Neighboring the router 35 are the emergency broadcast/marketing display (EBS) computers 36 which are responsive to individual remote instruction. Along with the EBS computers 36 are multi-array (local) computers 37 that will be programmed with the logic systems and algorithms necessary to make use of the invention's operation sub-assemblies. It will be appreciated that any number of computers 37 can be used with the invention.

As shown in FIG. 3, there is a communications device 38. This component is used for networking first responders' (Fire, Police, EMS, etc.) radios to each other (interoperability) and sending their radio transmissions back to a command center (GOMAC) via a network connection. The command center would then link the radio networks and control radio traffic as required.

Along with the communications device 38 is a computer-aided trace detection system (CATD) 39, described in more detail below. This sensor is able to extract air from the surrounding environment and determine whether explosives, chemicals, contraband, or other threats are present. Also included is a nuclear detection system 40, described below, which detects the presence of harmful neutrons found in the majority of nuclear weapons. Bordering the nuclear detection system 40 in FIG. 3 is a radiological detection system 41, also described more fully below. The radiological detection system 41 determines whether there is radiation in the surrounding environment using a Thallium doped Sodium Iodide crystal for the detection. Finally, in the front elevation illustration is an air-conditioning/heating unit 42 which regulates the temperature of the system.

Below is a more detailed description of the following sensors: the radiological detection system 41, the nuclear detection system 40 and the computer-aided trace detection system 39.

Radiological Detection System

Generally, the radiation detector 41 uses a Thallium doped Sodium Iodide (NaI(Th)) crystal for the detection. This crystal is used based on its high sensitivity and it has better energy resolution compared to other scintillation crystals. After the radiation enters the radiation detector 41, the crystal scintillates and produces a burst of light that is proportional to the energy of the radiation that entered. The burst of light from the crystal enters a photo multiplier tube (PMT) that is attached to the crystal. The PMT then outputs a voltage spike that is proportional to the energy of the original radiation. The voltage spike is captured and digitized. This digitized information is then sent to the memory of the radiation detector 41 for storage. After thousands of the gamma rays are digitized and stored, a radiation spectrum becomes visible. This spectrum will have peaks that are caused by the specific isotopes that were generating the radiation. By measuring the location of the peaks, the isotope that caused the radiation can be identified and can differentiate between multiple and "masked" sources.

The details of the detection process are further described below. The first part of the detection process is to capture a spectrum that contains as much of the mystery radiation (signal) as possible, and as little of the background radiation (noise) as possible. To do this, the acquisition start time of the spectrum should start as soon as the mystery radiation is present, and stop as soon as the mystery radiation disappears. This approach will not only maximize the signal to noise ratio of the spectrum, but it will also optimize the detection statistics. To accomplish this, a moving average of short interval spectrums is stored in the memory of the detector 41. Unlike conventional moving average techniques, partial moving averages are also analyzed. This provides not only the advantages provided by the moving average method with respect to the uncertainty of the arrival time of the mystery radiation, but also provides fast alarms on strong sources like the sequential-probability ratio test method. Analysis of the various partial moving averages also provides a start time for the presence of the mystery radiation.

The detection threshold is set by calculating a level that is statistically significant enough to prevent false alarms due to statistical fluctuation in the background radiation. The threshold level is typically set at seven standard deviations above the background. This threshold level provides a false alarm rate due to statistical fluctuation that is less than 1 per year. Higher thresholds can be set if lower false alarm rates are required. The threshold is specified in units of standard deviation; however, the threshold is in fact related to the statistical confidence of a Gaussian distribution with that number of standard deviations. Since radiation counts follow Poisson statistics, not Gaussian statistics, if a pure standard deviation threshold was used the probability of false alarms would be dependant on the background radiation rate. To prevent unexpectedly high false alarm rates at low background radiation rates, the true statistical confidence of a Poisson distribution is used.

The radiation detection system 41 uses a very advanced algorithm to accelerate the discrimination process and increase the speed and detection of high threat isotopes.

When radiation is detected, a message is sent back to the local computer 37 that is monitoring all local detectors. The message includes information on the strength of the radiation and the energy range of the most statistically significant radiation. Often the most significant radiation comes from the lowest energy major photo-peak of the isotope. This can be used to provide rapid warning for high threat isotopes that would be likely candidates for use in a dirty bomb. The local computer 37 can also pull a spectrum from the detector for further analysis.

When the radiation source leaves the area of the radiation detector 41, the detector automatically determines the time when the radiation left and saves a spectrum from the interval of the start of the radiation to the end of the radiation. This spectrum is then saved in non-volatile memory in the detector 41 and is available for analysis by the local computer.

In addition to processing alarm spectra, the detector 41 also periodically collects background spectra and auto-calibrates using an onboard known standard source. The background spectrum is used to calculate alarm thresholds and is available for subtraction by the local computer 37 to improve analysis of alarm spectra. The background spectrum is collected continuously and simultaneously while the detector 41 looks for threat radiation sources. At the end of the background collection period, the detector 41 checks its health by measuring internal voltages and performing an energy calibration.

When a spectrum is collected by the local computer 37, it is also sent to the Global Operations and Monitoring and Analysis Center (GOMAC). The GOMAC provides support for users of the radiation detectors 41 for 24 hours a day, 7 days a week. A scientist is available to view the spectrum and provide feedback on the cause of the alarm if requested. The GOMAC can also monitor the data feed and look for detector abnormalities that the detector itself may not notice. The GOMAC can also send notification that it is time to perform preventative maintenance based on detector readings.

Nuclear Detection System

Special Nuclear Material (SNM) is the material used in nuclear weapons such as highly enriched uranium (HEU) and weapons grade plutonium. A gamma ray only detection system can have difficulties distinguishing between certain types of radioactive material and potential nuclear weapons. All SNM share a common property in that they emit neutrons. A nuclear detection system 40 allows for confirmation of a possible SNM detection. This sensor also aids in the detection of well-shielded nuclear weapons. Neutrons are even more difficult to stop than gamma rays.

Some types of neutron detectors will falsely indicate the presence of neutrons if they are subjected to a strong gamma radiation beam. A key characteristic of the nuclear detector 40 is its insensitivity to gamma rays. Lithium 6 glass is an example of this type of detector. The nuclear detector 40 is constructed with lithium 6 glass specifically to avoid this problem. The first part of the detector is a plastic coating around the detection chamber. The plastic is used to moderate the neutrons so they will interact better with the lithium 6. The neutrons then pass through the metal wall of the chamber. This metal wall is used to shield against alpha and beta radiation that might be present in the background, it also is used to complete the circuit of the ionization detector. Once the neutrons are in the chamber some of them will interact with the lithium 6 on the walls. When a neutron interacts with lithium 6, it produces alpha radiation. The alpha radiation interacts with the gas and produces a large amount of ionization. The size of the ionization charge is recorded to determine if it was a neutron. Gamma rays also produce ionization of the gas, but because gamma rays do not interact well with the gas, they only produce a small amount of ionization and past quickly through the chamber with most of their energy. The differentiation of the amount of ionization allows the nuclear detection system 40 to distinguish between neutrons and gamma rays.

Computer-Aided Trace Detection System

As one of the operation sub-assemblies, a trace chemical detection and identification sensor will effectively isolate and identify chemicals in a sample gas stream. Specifically, this computer-aided trace detection system (CATD) 39 can extract air from the surrounding environment to determine whether weapons of mass destruction, explosives, firearms, contraband or humans are present. The CATD 39 utilizes mass spectral analysis, ionization technology, and reference computers.

The first task of the CATD 39 is to collect and filter an air sample from the surrounding environment. In the preferred embodiment, the detection system will automatically collect an air sample in predetermined time increments. The detection system will preferably be made of polytetrafluoroethylene (PTFE) and PFA Teflon® because these materials will not present chemical compatibility problems during air sample collection. A cyclonic filter with a grit pot should be attached to the system to remove large particles and dust from the air sample. A Teflon® membrane filter can also be utilized to remove even sub-micron sized particles.

The second task of the CATD 39 is to concentrate the chemicals of interest from the collected air sample. A chemical of interest can be defined as any chemical that is not a normal major constituent of air such as nitrogen, oxygen, water, carbon dioxide, and argon. To concentrate the chemicals of interest, the air sample can be sent past a chemical absorptive resin like Tenax®.

The third task of the CATD 39 is to separate the chemicals of interest so that the identification system only has to identify a single chemical at a time. The separation is facilitated by heating the Tenax® to release the chemicals it has absorbed, and then feeding the chemicals into a gas chromatograph (GC) column. The heating cycle on the Tenax® produces a pulse of chemicals that enters the GC at a predetermined time. As the pulse of chemicals travels through the GC, the lighter more volatile chemicals travel faster than the heavier less volatile chemicals. This difference in travel speed causes the chemicals to separate. At the end of the GC column, the individual chemicals of interest will arrive at different times.

The fourth task of the CATD 39 is to identify the individual chemicals that were isolated by the GC. It will be appreciated that mass spectroscopy is a useful technique for identifying a wide range of chemicals. Mass spectroscopy consists of two main components, (1) the ionization of the sample, and (2) the measurement of the mass to charge ratio of the ions created by the ionization. Databases containing over 100,000 electron ionization mass spectra are used to aid identification. For some mass spectra, after the database is checked there will still exist a list of a few possible chemical compounds that could have produced the mass spectra observed. In this case, the true chemical can often be determined by using high resolution spectroscopy in a technique called ion composition elucidation (ICE). With this technique, the molecular weight is measured to not only the integer value in Daltons, but to the micro Dalton (mDa) level.

Adjacent to the multi array computers 37 is a gas detection system 43. This is comprised of specific gas sensors with transmitter, vacuum pump and tubing for air intake. The vacuum pump pulls filtered air through the gas sensors. When the sensor identifies the threat gas, it sends a signal to the transmitter, which confirms the gas and the concentration. The gas detector (sensor and transmitter) are gas specific and can be combined to detect a wide variety of dangerous (threat) gases.

It should be appreciated that several temperature, tamper and vibration sensors are located throughout the apparatus. These sensors will monitor the overall system health. At least one temperature sensor is included to monitor the temperature of the interior chamber. At least one tamper sensor is included to monitor unauthorized intrusion of the interior chamber. Finally, at least one vibration sensor is included to monitor detrimental vibration levels.

An uninterruptible power supply ("UPS") 44 is integrated into the apparatus to supply power to all components in the event of a power failure or disconnect. Rechargeable batteries can be used to also supply back-up power to the components A transformer may be incorporated to supply 110V to the UPS when other input voltages are present. Finally, the apparatus can comprise of a switch (i.e., an inverter) to convert DC battery power to AC equipment power.

It should be appreciated that merely a preferred embodiment of the invention has been described above. However, many modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

What is claimed is:

1. A method of detecting and monitoring a threat, comprising steps of:

monitoring, via one or more sensors, surroundings of the one or more sensors, wherein at least one sensor is a computer-aided trace detection system, the computer-aided trace detection system configured to collect an air sample from the surroundings, concentrate a first chemical of interest from the collected air sample, separate the first chemical of interest from another chemical of interest present in the collected air sample using a gas chromatograph, and identify the first chemical of interest using a mass spectrometer, wherein the monitoring step comprises determining whether at least one of nuclear material or nuclear by-product are present in the surroundings;

the sensors, responsive to monitoring, generating information related to the surroundings;

transmitting the information related to the surroundings to a logic system;

at the logic system, processing the information related to the surroundings according to pre-selected instructions;

transmitting the processed information to a network;

responsive to the processed information, generating a message for display on a display device; and displaying the generated message on the display device.

2. The method of claim 1, further comprising receiving, at the logic system, remote instructions via the network.

3. The method of claim 1, wherein the surroundings are selected from the group consisting of: radiation, chemicals, nuclear materials, nuclear by-products, images, behavioral characteristics, gases and vibrations.

4. The method of claim 1, further comprising broadcasting an audio message related to the processed information.

5. The method of claim 1, wherein the monitoring step comprises collecting air from the surroundings and determining whether a threat is present in the collected air.

6. The method of claim 5, wherein the collecting step comprises automatically collecting air in predetermined time increments.

7. The method of claim 5, wherein the threat is at least one of explosives, chemicals, contraband, or gases.

8. The method of claim 1, wherein at least one sensor is a radiological detection system.

9. The method of claim 8, wherein the monitoring step comprises determining whether radiation is present in the surroundings.

10. The method of claim 1, wherein at least one sensor is a nuclear detection system.

11. The method of claim 1, wherein the monitoring step comprises receiving images at a camera array and determining whether at least one of dangerous or suspicious human behaviors, dangerous or suspicious incidents, or dangerous or suspicious objects are present in the surroundings.

12. The method of claim 11, wherein the monitoring step is conducted in real-time.

13. The method of claim 1, wherein the pre-selected instructions include a predetermined detection threshold level.

* * * * *